US009046301B2

(12) United States Patent
Park et al.

(10) Patent No.: US 9,046,301 B2
(45) Date of Patent: Jun. 2, 2015

(54) REFRIGERATOR CONDENSATE DRAIN PIPE WITH END CAP FOR FACILITATING OPENING OF REFRIGERATOR DOOR

(71) Applicant: LG ELECTRONICS INC., Seoul (KR)

(72) Inventors: Kyongbae Park, Seoul (KR); Donghoon Lee, Seoul (KR); Hyoungkeun Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 293 days.

(21) Appl. No.: 13/644,450

(22) Filed: Oct. 4, 2012

(65) Prior Publication Data

US 2013/0081420 A1 Apr. 4, 2013

(30) Foreign Application Priority Data

Oct. 4, 2011 (KR) ..... 10-2011-0100470

(51) Int. Cl.
*F25D 21/14* (2006.01)
*F25D 17/04* (2006.01)

(52) U.S. Cl.
CPC ..... *F25D 21/14* (2013.01); *F25D 17/047* (2013.01); *F25D 2321/146* (2013.01)

(58) Field of Classification Search
CPC .. F25D 17/047; F25D 21/14; F25D 2321/146
USPC ..... 62/285
See application file for complete search history.

(56) References Cited

U.S. PATENT DOCUMENTS

2006/0277934 A1* 12/2006 Cho ..... 62/285
2010/0269531 A1 10/2010 Samdan et al.

FOREIGN PATENT DOCUMENTS

| | | | |
|---|---|---|---|
| DE | 31 27 749 | A1 | 2/1983 |
| JP | 60 083879 | U | 6/1985 |
| JP | 2005/226964 | A | 8/2005 |
| JP | 2005241139 | A | 9/2005 |
| KR | 1020080054524 | A | 6/2008 |
| KR | 100853434 | B1 | 8/2008 |
| KR | 1020090130526 | A | 12/2009 |
| WO | WO 2006/067767 | | 6/2006 |
| WO | 2008025636 | A2 | 3/2008 |

* cited by examiner

*Primary Examiner* — Cassey D Bauer
(74) *Attorney, Agent, or Firm* — McKenna Long & Aldridge LLP

(57) ABSTRACT

Provided is a refrigerator, which includes a drain pan, a drain pipe, and a drain cap. The drain pan is disposed under an evaporator, and includes a drain port through which defrosted water is discharged. The drain pipe is coupled to the drain port. The drain cap is installed inside of the drain pipe. A flip member disposed inside of the drain cap is integrally formed with the drain cap and is bendable.

5 Claims, 4 Drawing Sheets

REFRIGERATOR CONDENSATE DRAIN PIPE WITH END CAP FOR FACILITATING OPENING OF REFRIGERATOR DOOR

CROSS-REFERENCE TO RELATED APPLICATIONS

The present application claims the benefits of priority to Korean Patent Application No. 10-2011-0100470 (filed on Oct. 4, 2011), which is herein incorporated by reference in its entirety.

BACKGROUND

The present disclosure relates to a refrigerator.

In general, defrosted water formed by removing frost from an evaporator of a refrigerator is introduced into a machinery chamber through a drain member. In this case, a tube drain may be used to efficiently discharge the defrosted water. However, the tube drain may undesirably function as a passage through which hot air from the machinery chamber is introduced into the evaporator, which increases an inner load of the refrigerator and power consumption thereof.

To prevent such introduction of high temperature air into an evaporation chamber, a cap member may be installed on an outlet end of a drain tube.

FIG. 1 is a perspective view illustrating a drain pipe in the related art.

Referring to FIG. 1, a drain pipe 1 in the relate art includes: an inlet end 1*a* connected to a drain pan disposed under an evaporator; and an outlet end 1*b* installed on a machinery chamber. A drain cap 2 is installed on the outlet end 1*b*.

Under this structure, hot air staying in the machinery chamber is prevented from being introduced into an evaporation chamber. However, it may be difficult to open a refrigerator door. This is because when the refrigerator door is opened, the inner space of a refrigerator is under negative pressure.

SUMMARY

Embodiments provide a drain pipe for a refrigerator, which prevents introduction of hot air from a machinery chamber into a refrigerator, and facilitates opening of a refrigerator door.

In one embodiment, a refrigerator includes: a drain pan disposed under an evaporator and including a drain port through which defrosted water is discharged, a drain pipe coupled to the drain port, and a drain cap installed inside of the drain pipe, wherein a flip member disposed inside of the drain cap is integrally formed with the drain cap and is bendable.

According to the embodiments, introduction of hot air from a machinery chamber into an evaporator can be minimized. In addition, when a refrigerator door is opened, a flip member is rotated to open an air passage, thereby removing a pressure difference between the inside and outside of a refrigerator. Thus, the refrigerator door can be easily opened.

The details of one or more embodiments are set forth in the accompanying drawings and the description below. Other features will be apparent from the description and drawings, and from the claims.

DETAILED DESCRIPTION OF THE EMBODIMENTS

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Hereinafter, a drain pipe for a refrigerator according to embodiments will be described in detail with reference to the accompanying drawings.

Figure 1:
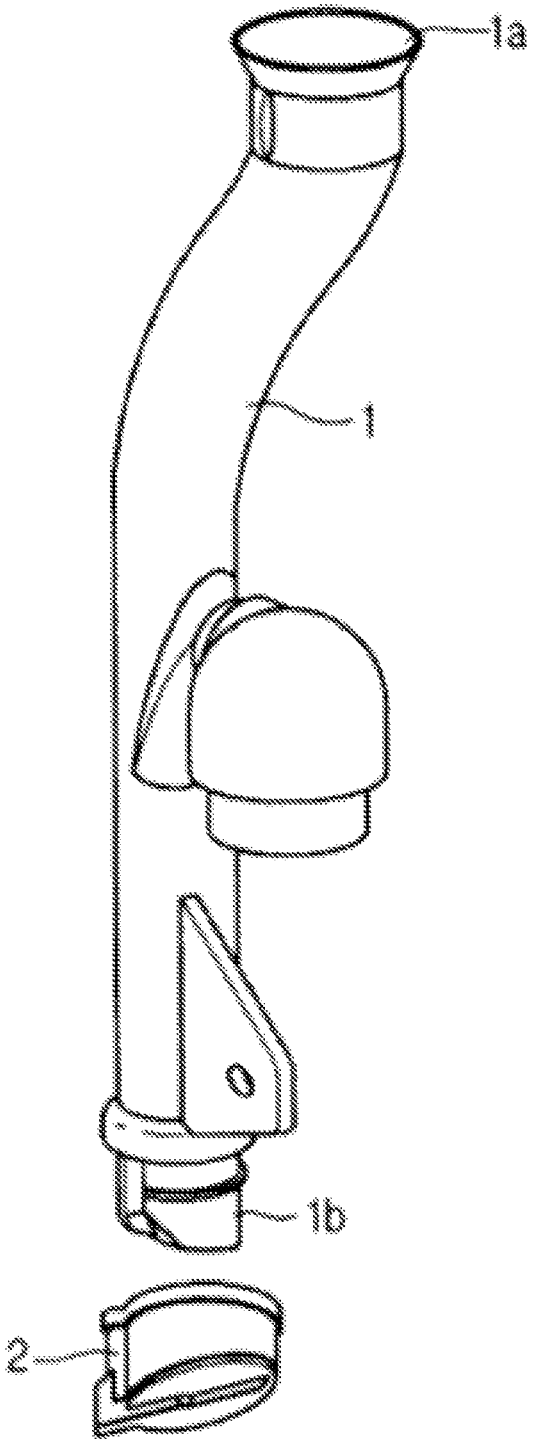
FIG. 1 (PRIOR ART)
FIG. 1 is a perspective view illustrating a drain pipe in the related art.
Figure 2:
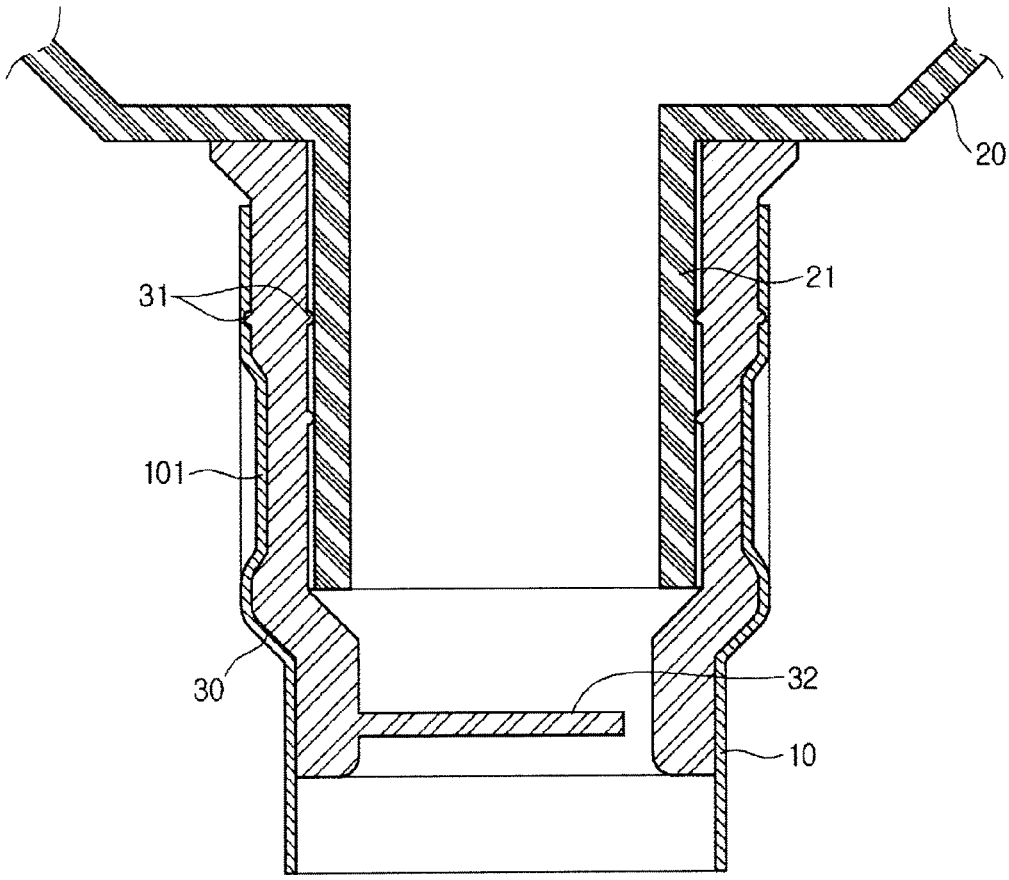
FIG. 2 is a vertical cross-sectional view illustrating a drain pipe coupling structure for a refrigerator according to an embodiment.

FIG. 2 is a vertical cross-sectional view illustrating a drain pipe coupling structure for a refrigerator according to an embodiment.

Referring to FIG. 2, a drain pipe coupling structure for a refrigerator according to the current embodiment includes: a drain pipe 10 installed on a drain port 21 disposed on the bottom of a drain pan 20; and a drain cap 30 fitted in an inlet end of the drain pipe 10.

In particular, the drain port 21 has a pipe shape extending downward from the bottom of the drain pan 20. The drain pan 20 is installed on the bottom of an evaporation chamber of a refrigerator to receive defrosted water dropped from an evaporator. Then, the defrosted water collected in the drain pan 20 is discharged through the drain port 21.

The drain cap 30 tightly contacts the inner circumferential surface of the inlet end of the drain pipe 10. The drain port 21 tightly contacts the inner circumferential surface of the drain cap 30.

Anti-slip protrusions 31 having a strip shape may be extended in the circumferential direction of the drain cap 30 to surround at least one of the inner and outer circumferential surfaces of the drain cap 30. The anti-slip protrusions 31 tightly contact at least one of the inner circumferential surface of the drain pipe 10 and the outer circumferential surface of the drain port 21, thereby preventing the drain cap 30 from being removed from at least one of the drain pipe 10 and the drain port 21.

A recess part 101 may be recessed inward in a portion of the outer circumferential surface of the drain pipe 10, particularly, in a portion contacting the drain cap 30. The drain cap 30 is doubly prevented from being removed from the drain pipe 10 by means of the recess part 101.

A flip 32 may be disposed on the inner circumferential surface of the drain cap 30 near an outlet end thereof, and be extended in a direction perpendicular to the longitudinal direction of the drain cap 30. That is, the flip 32 is extended in a direction to close the inner space of the drain cap 30. The flip 32 may have a shape that is similar or identical to an inner cross section of the drain cap 30, so as to substantially close the inner space of the drain cap 30.

The flip 32 may be integrally formed with the drain cap 30, and be formed of a flexible material so that the flip 32 can be vertically bent.

Figure 3:
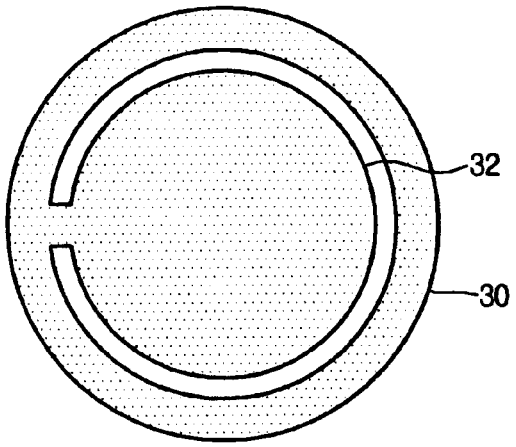
FIG. 3 is a plan view illustrating a flip according to a first embodiment.

FIG. 3 is a plan view illustrating a flip according to a first embodiment.

Referring to FIG. 3, a flip 32 according to the first embodiment may have a planar shape corresponding to an inner horizontal cross section of the drain cap 30 and be slightly smaller than a cross section of the inner space of the drain cap 30.

The inner horizontal cross section of the drain cap 30 is circular. The flip 32 has a circular shape, the diameter of which is slightly smaller than that of the inner horizontal cross section of the drain cap 30. The flip 32 is integrally formed with the inner circumferential surface of the drain cap 30.

Figure 4:
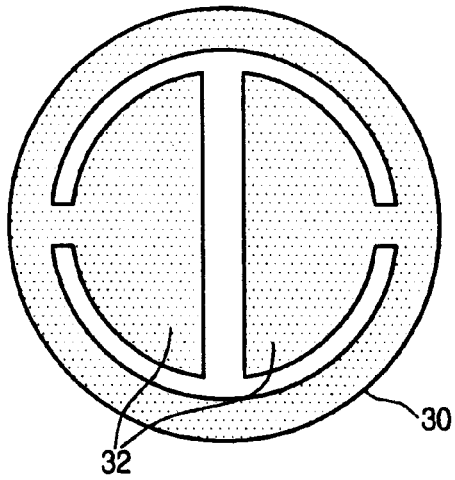
FIG. 4 is a plan view illustrating a flip according to a second embodiment.

FIG. 4 is a plan view illustrating a flip according to a second embodiment.

Referring to FIG. 4, a flip 32 according to the second embodiment is disposed inside of the drain cap 30, and includes half circular structures that are symmetrical to each other.

In particular, the half circular structures of the flip 32, facing each other, are individually extended from the inner circumferential surface of the drain cap 30, and are integrally formed therewith. That is, the flip 32 includes a first flip and a second flip, face-to-face ends of which are spaced apart from each other by a predetermined distance. Alternatively, the face-to-face ends of the first and second flips may contact each other. In other words, when a refrigerator door is closed, the first and second flips contact each other so as to substantially close the inner space of the drain cap 30. When the refrigerator door is opened, the first and second flips are bent upward. When the first and second flips are bent upward, the distance between the face-to-face ends is increased to thereby open a passage for passing outer air.

Figure 5:
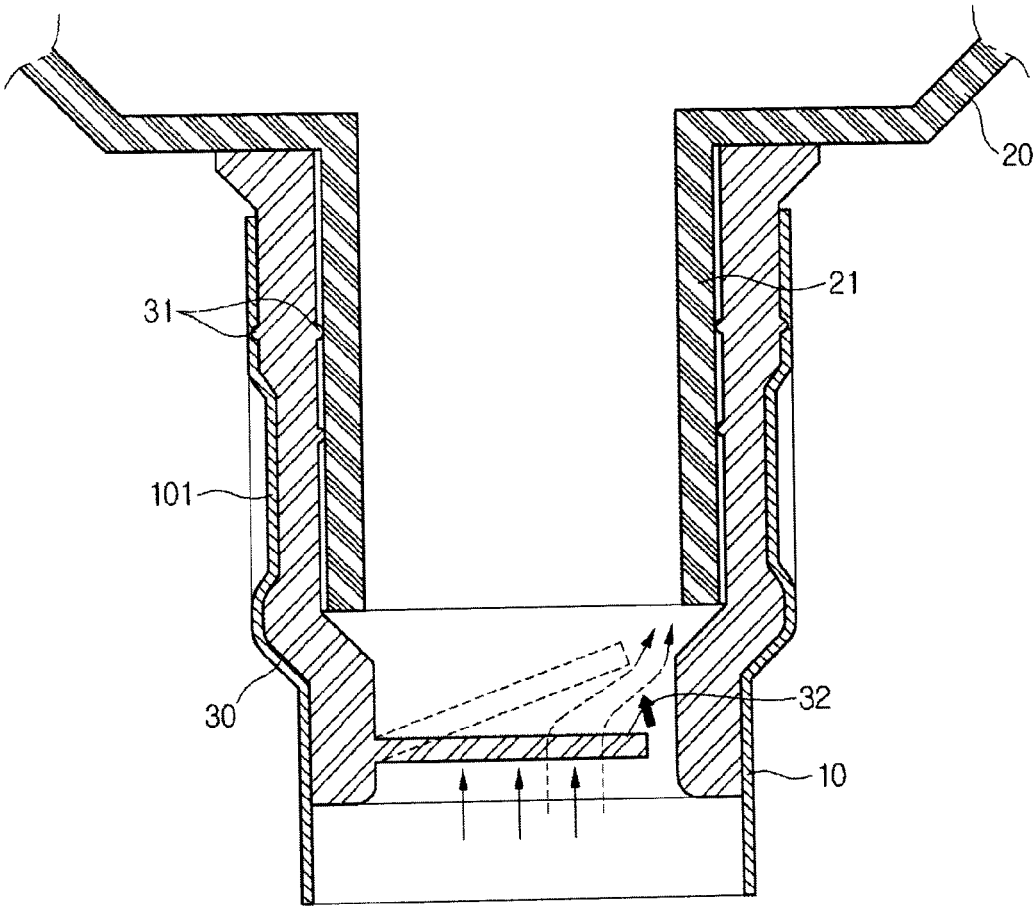
FIG. 5 is a cross-sectional view illustrating states of a flip according to whether a refrigerator door is closed or opened, according to an embodiment.

FIG. 5 is a cross-sectional view illustrating states of a flip according to whether a refrigerator door is closed or opened, according to an embodiment.

Referring to FIG. 5, when a refrigerator door is closed, the flip 32 is maintained in a horizontal position, that is, in a position to close an inner passage of the drain cap 30. Thus, introduction of outer air into an evaporation chamber is minimized, whereby the increase of an inner load of the evaporation chamber and a refrigerator is minimized.

When the refrigerator door is opened, the flip 32 is bent upward by a pressure difference between the inside and outside of the refrigerator, thereby opening the inner passage of the drain cap 30. Accordingly, air is introduced into the evaporation chamber from a machinery chamber through the inner passage, whereby the pressure difference between the inside and outside of the refrigerator is substantially removed, so that the refrigerator door can be efficiently opened.

Further, the drain cap 30 may be installed on an outlet end of the drain pipe 10 as well as the inlet end of the drain pipe 10.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A refrigerator comprising:

a drain pan disposed under an evaporator and comprising a drain port through which defrosted water is discharged;

a drain pipe coupled to the drain port; and a drain cap installed inside of the drain pipe, wherein a flip member disposed inside of the drain cap is integrally formed with the drain cap and is bendable, wherein an anti-slip protrusion is extended in a circumferential direction of the drain cap to surround at least one of inner and outer circumferential surfaces of the drain cap, and wherein a recess part for preventing removal of the drain cap from the drain pipe is disposed in a circumferential direction of the drain pipe on an outer circumferential surface of the drain pipe contacting the outer circumferential surface of the drain cap.

2. The refrigerator according to claim 1, wherein the drain cap is fitted in an inlet end of the drain pipe, and the drain port is installed in the drain cap.

3. The refrigerator according to claim 1, wherein the drain cap is fitted in an outlet end of the drain pipe.

4. The refrigerator according to claim 1, wherein the flip member has a shape corresponding to a cross section of the drain cap.

5. The refrigerator according to claim 1, wherein the flip member comprises a pair of flips extending from an inner circumferential surface of the drain cap, and the flips are disposed in positions facing each other, and are symmetrical to each other.

* * * * *